US008770112B2

(12) United States Patent
Mollet et al.

(10) Patent No.: US 8,770,112 B2
(45) Date of Patent: Jul. 8, 2014

(54) TRANSPORT EQUIPMENT WITH A VEHICLE GUIDED ALONG A SINGLE TRAFFIC LANE

(71) Applicants: Alain Mollet, Annecy le Vieux (FR); Eric Blanc, Bourgoin Jallieu (FR)

(72) Inventors: Alain Mollet, Annecy le Vieux (FR); Eric Blanc, Bourgoin Jallieu (FR)

(73) Assignee: Pomagalski, Voreppe (FR)

( * ) Notice: Subject to any disclaimer, the term of this patent is extended or adjusted under 35 U.S.C. 154(b) by 0 days.

(21) Appl. No.: 13/766,299

(22) Filed: Feb. 13, 2013

(65) Prior Publication Data

US 2013/0145954 A1 Jun. 13, 2013

Related U.S. Application Data

(63) Continuation of application No. 13/257,133, filed as application No. PCT/FR2010/000129 on Feb. 16, 2010, now abandoned.

(30) Foreign Application Priority Data

Mar. 16, 2009 (FR) ..... 09 01218

(51) Int. Cl.
*B60B 9/00* (2006.01)
*E01B 25/15* (2006.01)
*B60V 3/04* (2006.01)

(52) U.S. Cl.
USPC ..... 104/184; 104/130.07; 104/173.1; 104/202

(58) Field of Classification Search
USPC ..... 104/130.01, 130.07, 173.1, 178, 184, 104/185, 193, 202
See application file for complete search history.

(56) References Cited

U.S. PATENT DOCUMENTS

| | | | |
|---|---|---|---|
| 3,098,454 | A | 7/1963 | Maestrelli |
| 3,812,788 | A | 5/1974 | Laurent |
| 4,092,929 | A | 6/1978 | Laurent |
| 4,327,647 | A | 5/1982 | Eisenkolb |
| 4,550,663 | A | 11/1985 | DeViaris |
| 5,419,261 | A | 5/1995 | Tarassoff et al. |
| 5,582,109 | A | 12/1996 | Levi et al. |
| 5,819,668 | A | 10/1998 | Meindl |
| 6,308,636 | B1 | 10/2001 | Collins et al. |
| 6,418,856 | B2 | 7/2002 | Hossfield et al. |

(Continued)

FOREIGN PATENT DOCUMENTS

| | | |
|---|---|---|
| EP | 0 347 324 A1 | 12/1989 |
| EP | 1 193 153 A1 | 4/2002 |

(Continued)

OTHER PUBLICATIONS

Aug. 18, 2010 International Search Report issued in Patent Application No. PCT/FR2010/000129.

(Continued)

*Primary Examiner* — Zachary Kuhfuss
(74) *Attorney, Agent, or Firm* — Oliff PLC

(57) ABSTRACT

A transport installation comprising at least one carrier vehicle moving longitudinally in to-and-fro manner along a single running track being guided by two guiding elements each following one of the lateral branches of the track in a crossing area. The carrier vehicle carries two independent gripping mechanisms respectively associated with the two guiding elements and each able to temporarily secure the carrier vehicle in the lateral direction to the associated guiding elements. Such gripping mechanisms constitute on-board devices for selecting the branch associated with its direction of running on entering a crossing area.

5 Claims, 2 Drawing Sheets

(56) References Cited

U.S. PATENT DOCUMENTS

| | | | |
|---|---|---|---|
| 2010/0294161 | A1 | 11/2010 | Bavaresco et al. |
| 2011/0226152 | A1 | 9/2011 | Mollet |
| 2012/0125222 | A1 | 5/2012 | Heinzle et al. |

FOREIGN PATENT DOCUMENTS

| | | | |
|---|---|---|---|
| EP | 1 193 344 | A1 | 4/2002 |
| EP | 1 193 153 | B1 | 12/2003 |
| FR | 941934 | | 1/1949 |
| FR | 2 133 102 | | 11/1972 |
| FR | 2 460 821 | | 1/1981 |
| FR | 2 500 799 | | 9/1982 |

OTHER PUBLICATIONS

Sep. 20, 2011 International Preliminary Report on Patentability issued in Patent Application No. PCT/FR2010/000129.

TRANSPORT EQUIPMENT WITH A VEHICLE GUIDED ALONG A SINGLE TRAFFIC LANE

This is a Continuation application of U.S. application Ser. No. 13/257,133 filed Sep. 30, 2011, which is a National Phase of International Application No. PCT/FR2010/000129 filed Feb. 16, 2010, which claims the benefit of priority to French Patent Application No. 09 01218 filed on Mar. 16, 2009. The disclosure of each of the prior applications is hereby incorporated herein by reference in its entirety.

BACKGROUND

The invention relates to a transport installation comprising:

- at least one carrier vehicle resting on the ground to move longitudinally in to-and-fro manner along a single running track,
- two end terminals connected by the running track,
- at least one crossing area where the running track is locally split into two laterally offset branches each respectively associated with outgoing movement and return movement of the carrier vehicle,
- at least one pair of main support units carried by the carrier vehicle,
- and two guiding elements arranged along the track to guide the carrier vehicle laterally in cooperation with the main support units, and each following one of the lateral branches in continuous manner.

Such a transport installation with a passive carrier vehicle made to run along the running track by possibly reversible securing to hauling ropes running in opposite directions is known for example from the document EP1193153B1. But the disclosed solution does not make mention of the means implemented to guide the carrier vehicles along one branch during outgoing movement and along the other branch during return movement. Such an organization of the carrier vehicles does however represent a real problem.

A first solution for guiding a carrier vehicle along a running track, known for example from the document FR2500799, consists in permanent clamping of a guide buckling arranged in continuous manner along the track. But the permanent nature of the guiding link between the carrier vehicle and the buckling of the track does not enable the carrier vehicles to be guided along one branch during outgoing movement and along the other branch during return movement.

A second solution consists in providing at least one guiding elements arranged along the track and comprising a mobile section on entry and on exit from the crossing area, acting like a points switching system. But this solution remains problematic as it is very cumbersome and implements moving parts arranged on the track, rendering the latter liable to be damaged and constituting sources of danger.

SUMMARY

The object of the invention consists in providing an installation of the above-mentioned type that is simple, dependable, inexpensive, and efficient.

The installation according to the invention is remarkable in that the carrier vehicle carries two independent gripping mechanisms respectively associated with the two guiding elements and each being able to temporarily secure the carrier vehicle in the lateral direction to the associated guiding elements, constituting on-board devices for selecting the branch associated with its direction of running on entering the crossing area.

The gripping mechanisms are carried on-board the carrier vehicle, thereby eliminating any possibility of damage by ill-intentioned persons, and enhancing overall safety by eliminating moving parts from the running track. To guide the carrier vehicles along one branch during outgoing movement and along the other branch during return movement, one of the gripping mechanisms simply has to be commanded to an active position on outgoing movement, and the other gripping mechanism be commanded to an active position on return movement.

According to a preferred embodiment, each gripping mechanism comprises an auxiliary support unit able to be moved by actuating devices between an active position engaged with the associated guiding elements and a standby position separated from the associated guiding elements. Control of a gripping mechanism is therefore achieved in very simple manner by activation of the actuating devices.

Other technical features can be used either alone or in combination:

- in its active position, the auxiliary support unit laterally clamps the associated guiding elements in cooperation with the main support units,
- the auxiliary support unit of a gripping mechanism is formed by a rotating sheave with a vertical axis of rotation rolling in the active position on an outer running path of the associated guiding elements facing the outside of the track,
- the actuating devices comprise an arm mounted rotating at one end on the carrier vehicle and supporting the auxiliary support unit at its other end,
- the main support units are formed by a rotating wheel with a vertical axis of rotation rolling on an inner running path of the associated guiding elements facing the inside the track.

BRIEF DESCRIPTION OF THE DRAWINGS

Other advantages and features will become more clearly apparent from the following description of a particular embodiment of the invention given for non-restrictive example purposes only and represented in FIG. 1, illustrating a section of the running track in a lateral vertical cross-sectional plane.

DETAILED DESCRIPTION OF THE EMBODIMENTS

Figure 1:
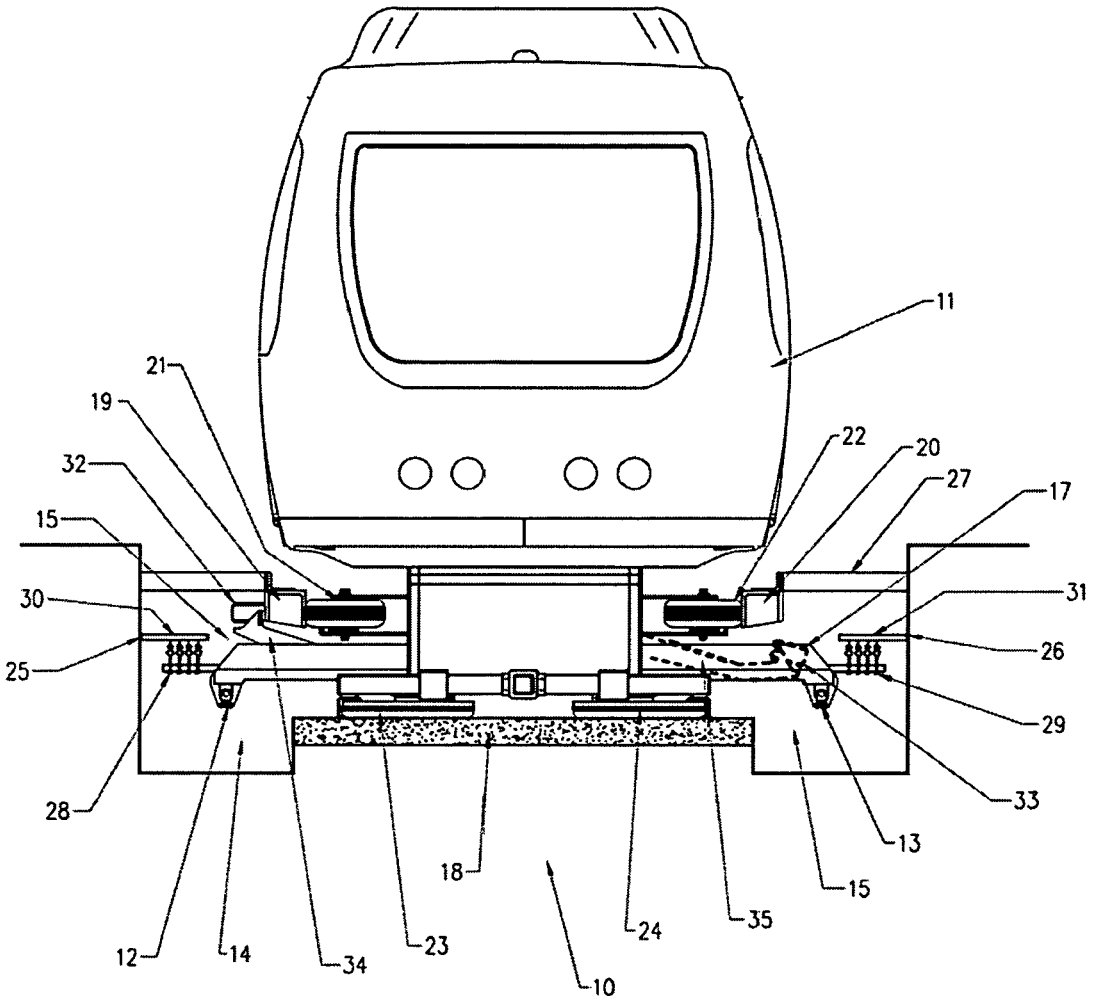
FIG. 1 shows a section of the running track in a lateral vertical cross-sectional plane.
Figure 2:
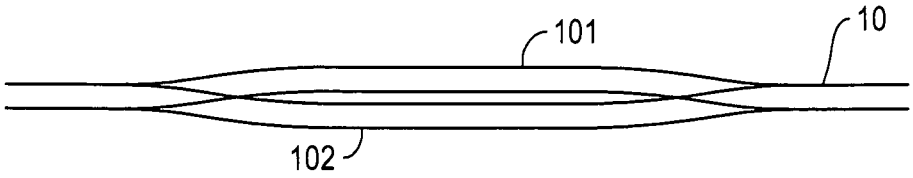
FIG. 2 shows two laterally offset branches 101, 102 each respectively associated with outgoing movement and return movement of the carrier vehicle.

As shown in FIG. 1, the illustrated transport installation comprises a single running track 10 along which at least one passive carrier vehicle 11 resting on the ground runs in longitudinal manner to move in to-and-fro manner along the running track. Two end terminals (not shown) are joined by running track 10, whereas hauling ropes (only two hauling ropes 12, 13 are illustrated at the level of a given lateral cross-section), to which carrier vehicle 11 is successively coupled to be hauled on track 10, are arranged along the part of at least one of the lateral edges 14, 15 of running track 10 by support means of carrier ropes 12, 13 during running. A drive unit (not shown) is associated with each hauling rope 12, 13 to make the latter run along track 10.

Running track 10 is equipped with two guiding elements arranged along the track to guide the carrier vehicle laterally during movement of the latter along the track, whereas the carrier vehicle comprises support means to keep the latter secured to the ground at the level of a central path 18 arranged between its lateral edges 14, 15.

In the case where central path 18 consists of a flat surface, the support means can be formed by air cushions 23, 24 arranged underneath carrier vehicle 11, as represented in the single FIGURE, or by steerable wheels.

The guiding elements are for example formed by two lateral flanks 19, 20 each extending along a lateral edge 14, 15 of the track. Carrier vehicle 11 carries two rotating wheels 21, 22 with a vertical axis of rotation each running on an inner running path of the associated guiding elements to keep carrier vehicle 11 running along a predefined trajectory. Each of the inner running paths is facing the inside of the track. Each wheel 21, 22 constitutes a main support unit arranged underneath the carrier vehicle, above air cushions 23, 24. In the case where running track 10 is arranged in the form of a trench located below ground level, lateral flanks 19, 20 can be fixed to side edges 25, 26 of the trench by means of support arms 27. The carrier vehicle thus carries at least one pair of main support units 21, 22, laterally offset from one another to respectively collaborate with guiding elements 19, 20 so that guiding elements 19, 20 guide the carrier vehicle laterally by mechanical cooperation with main support units 21, 22.

Carrier vehicle 11 comprises two gripping mechanisms 16, 17 arranged on the opposite lateral sides of carrier vehicle 11, i.e. outside the volume situated underneath the carrier vehicle, and each enabling carrier vehicle 11 to be engaged individually in reversible manner on hauling rope 12, 13 of lateral edge 14, 15 of the track corresponding to the lateral side of the carrier vehicle. Each gripping mechanism 16, 17 can for example comprise a plurality of detachable clamps staggered longitudinally along the corresponding lateral side of carrier vehicle 11. The assembly formed by gripping mechanisms 16, 17 and hauling ropes 12, 13 presents a symmetric configuration in the lateral direction.

The support means of carrier ropes 12, 13 are for example formed by guide sheaves arranged along each lateral edge of track 10. The support means perform lateral positioning of hauling ropes 12, 13 with respect to the running track.

Carrier vehicle 11 can comprise a single car comprising a body joined to a chassis resting on the ground by means of support means, or a train of cars.

The running track is locally split at least once into two laterally offset branches 101, 102 each respectively associated with outgoing movement and return movement of the carrier vehicle, enabling the carrier vehicles to cross in the event of there being a plurality of carrier vehicles. The local duplications of the track constitute crossing areas arranged along running track 10 between the end terminals. The running track comprises at least one crossing area that delineates successive sections of track. At least one hauling rope running in the required direction corresponding either to the outgoing direction or to the return direction runs along one of the lateral edges of each of the branches. Arranging the two gripping mechanisms on the opposite lateral sides of carrier vehicle 11 enables hauling of the carrier vehicle on one of the local duplication branches to be performed by means of one of the gripping mechanisms, and hauling of the carrier vehicle on the other local duplication branch to be performed by means of the other gripping mechanism.

Collection means can be incorporated on-board the carrier vehicle to supply the latter with electricity. The collection means will depend on the nature of the external electric power source. For example purposes, the collection means can be formed by current collectors 28, 29 with which conducting rails 30, 31 are associated equipping lateral edges 14, of the track to constitute the external electric power source. It can also be envisaged for the collection means and the external electric power source to collaborate remotely by magnetic induction.

Guiding elements 19, 20 are arranged so as to move away from one another laterally in each crossing area to each follow one of the lateral branches in continuous manner, i.e. without any longitudinal discontinuity of the guiding able to be performed by each of the guiding elements. Each of the guiding elements follows the branch corresponding to its side, on the outside of the branch: the left guiding elements are arranged along the left side of the left lateral branch, and the right guiding elements are arranged along the right side of the right lateral branch. Such an arrangement does not omit to provide other temporary guiding elements along the lateral branches on the insides of the branches. For example, the left lateral branch can be equipped with a right guiding elements distinct from the right guiding elements which continuously follow the right lateral branch.

In addition to the main support units, carrier vehicle 11 carries two independent gripping mechanisms respectively associated with the two guiding elements and each able to temporarily secure the carrier vehicle in the lateral direction to the associated guiding elements on entering the crossing area. The two gripping mechanisms constitute on-board devices for selecting the branch associated with its direction of running on entering the crossing area. The nature of the gripping depends in particular on the nature of the guiding elements.

In the illustrated embodiment, each gripping mechanism comprises an auxiliary support unit able to be moved by actuating devices between an active position engaged with the associated guiding elements and a standby position away from and disengaged from the associated guiding elements. Each auxiliary support unit is for example formed by a rotating sheave 32, 33 having a vertical axis of rotation and running in the active position on an outer running path of the associated guiding elements, the outer path being facing the outside of the track. The inner and outer running paths correspond for example to the respectively inner and outer surfaces of corresponding lateral flank 19, 20. The design of each rotating sheave 32, 33 and of its actuating devices is such that the sheave runs on a laterally opposite path to the path on which wheel 21, 22 normally runs. This results, in its active position, in auxiliary support unit 32, 33 laterally gripping associated guiding elements 19, 20 in cooperation with main support units 21, 22, creating selective and temporary mechanical securing of the carrier vehicle to the guiding elements in the lateral direction.

In the illustrated manner, the actuating devices can comprise an arm 34, 35 mounted rotating at one end on carrier vehicle 11 and bearing the auxiliary support unit at its opposite end. The standby position corresponds to a lowered state of arm 24, 35 and the active position to a raised state of the arm. In the figure, the left auxiliary support unit occupies its active position, and the right auxiliary support unit occupies its standby position. Rotational movement of the arm can be controlled by any suitable means such as an electric, hydraulic or pneumatic actuator.

On entering the crossing area, carrier vehicle 11 has to select the lateral branch of track corresponding to its direction of running. Control means perform switching to the active position of the gripping mechanism associated with the guiding elements following this lateral branch in continuous manner. The other gripping mechanism occupies its standby position so as to release the carrier vehicle with respect to the associated guiding elements. The gripping mechanism in the active position secures the carrier vehicle laterally to the associated guiding elements, while at the same time enabling longitudinal movement of the carrier vehicle along the guiding elements. As the guiding elements continuously follow the lateral branch corresponding to the direction of running, the carrier vehicle will naturally run on the lateral branch without requiring any mechanical switching. The second guiding elements following the other lateral branch no longer cooperate with the carrier vehicle during this operation. Movement in the opposite direction on the other lateral branch will on the other hand be achieved by commanding the other gripping mechanism to its active position. Outside the crossing area, the gripping mechanisms occupy their standby positions and only the main guiding elements are active in cooperation with the guiding parts. The control means performing the position changes of the gripping mechanisms can be carried on-board or be of mechanical type in the form of an actuating ramp arranged along the track to move a cam integral to the arm.

The operation described above can be adapted to other types of gripping mechanism, for example using a pin engaging in the active position in a slot arranged in the associated guiding elements. The means for moving the carrier vehicles can further be different, for example of self-propelling type. Finally the main support units could be formed by rotating wheels arranged to run on outer running paths arranged on the guiding elements on the outside of the track, which means can moreover be formed by any suitable means other than lateral flanks. A given crossing area can be arranged so as to constitute an intermediate terminal.

The invention claimed is:

1. A transport installation comprising:

at least one carrier vehicle resting on the ground to move longitudinally in two directions along a single running track, two end terminals connected by the running track, at least one crossing area where the running track is locally split into two laterally offset branches each respectively associated with outgoing movement and return movement of the carrier vehicle, at least one pair of main rollers carried by the carrier vehicle, and two guiding elements arranged along the track to guide the carrier vehicle laterally in cooperation with the rollers, and each guide element following one of the lateral branches in a continuous manner, wherein the carrier vehicle carries two independent gripping mechanisms arranged on opposite lateral sides of the carrier vehicle, outside a volume situated underneath the carrier vehicle, so as to engage individually in a reversible manner on hauling ropes of a lateral edge of the track, the gripping mechanisms being respectively associated with the two guiding elements and each being able to temporarily secure the carrier vehicle in the lateral direction to the associated guiding elements, the gripping mechanisms being on-board devices for selecting the branch associated with a running direction on entry to the crossing area, wherein each gripping mechanism comprises auxiliary support units able to be moved by actuating devices between an active position engaged with the associated guiding elements and a standby position separated from the associated guiding elements.

2. The installation according to claim 1, wherein, in the active position, the auxiliary support units laterally clamp the associated guiding elements in cooperation with the rollers.

3. The installation according to claim 2, wherein the auxiliary support units of a gripping mechanism is formed by a rotating sheave with a vertical axis of rotation rolling in the active position on an outer running path of the associated guiding elements facing the outside of the track.

4. The installation according to claim 1, wherein the actuating devices comprise an arm mounted rotating at one end on the carrier vehicle and supporting the auxiliary support units at another end on the carrier vehicle.

5. The installation according to claim 1, wherein the rollers are formed by a rotating wheel with a vertical axis of rotation rolling on an inner running path of the associated guiding elements facing the inside the track.

* * * * *